United States Patent [19]

Krause

[11] 3,943,730

[45] Mar. 16, 1976

[54] CONTROL DEVICE FOR KNITTING MACHINES

[75] Inventor: Erich Krause, Bopfingen, Germany

[73] Assignee: Universal Maschinenfabrik, Westhausen, Germany

[22] Filed: Apr. 25, 1974

[21] Appl. No.: 464,098

[30] Foreign Application Priority Data

Apr. 25, 1973 Germany ..... 2320845

[52] U.S. Cl. ..... 66/70

[51] Int. Cl.[2] ..... D04B 7/10

[58] Field of Search ..... 66/75, 70, 76, 154, 73, 66/154 A

[56] References Cited

UNITED STATES PATENTS

| | | | |
|---|---|---|---|
| 2,586,205 | 2/1952 | Cobert | 66/126 R |
| 3,053,065 | 9/1962 | Steiger | 66/154 A |
| 3,069,881 | 12/1962 | Warren | 66/154 A |
| 3,292,393 | 12/1966 | Ribler | 66/154 |
| 3,472,287 | 10/1969 | Ribler | 66/75 UX |
| 3,605,448 | 9/1971 | Ribler | 66/75 UX |

FOREIGN PATENTS OR APPLICATIONS

| | | | |
|---|---|---|---|
| 1,500,569 | 9/1967 | France | 66/75 |
| 1,197,944 | 7/1970 | United Kingdom | 66/76 |
| 1,017,996 | 1/1966 | United Kingdom | 66/70 |
| 1,164,130 | 9/1969 | United Kingdom | 66/154 A |
| 1,918,853 | 10/1970 | Germany | 66/75 |

*Primary Examiner*—Ronald Feldbaum

*Attorney, Agent, or Firm*—Sughrue, Rothwell, Mion & Zinn

[57] ABSTRACT

A limit switch arrangement for controlling the patterning and working width of knitted articles on a straight knitting machine includes a plurality of magnetically responsive switch on the movable carriage of the machine and a plurality of permanent magnets are mounted in an axially affect manner on a holder which is axially adjustable in the direction of travel of the carriage.

5 Claims, 6 Drawing Figures

CONTROL DEVICE FOR KNITTING MACHINES

RELATED PATENTS

In U.S. Pat. No. 3,817,059, issued on June 18, 1974, entitled "Method and Apparatus for Controlling a Knitting Machine" a knitting machine control system is disclosed which allows flexibility of control with minimal complexity of circuits and information storage apparatus by means of program arrangements which selectively call for control information from fixed storage units and from an eraseable temporary storage unit which is fed from magnetic tape. This patent which was copending with the present application and by the same applicant and substantially discloses but does not claim the present invention.

Field of the Invention

The present invention relates to a device for controlling the patterning and working width of a straight knitting machine comprising different storage devices for the data relating to knit types and patterning and devices for limiting the working width.

Description of the Prior Art

The advantage of straight knitting machines consists in that, in constrast to other knitting machines, they can be changed to other patterns relatively rapidly and the working width can be varied. As the preparation time is an extremely important factor in regard to employees wages, the ability to switch rapidly to other patterns is a money-saving feature. By altering the working width, the knitted articles can be adapted to the various requisite sizes and there is a minimum amount of wastage. This is particularly important in the case of expensive materials.

The knitting machines currently on the market do not generally convert readily to different patterns. In most cases it is necessary to switch needles, selectors and the like. Considerable expense is also involved in replacing Jacquard cards. To change the working width, the needles and selectors must either be rendered operative or inoperative. To effect this, it is necessary, particularly in the case of machines comprising selector control means and machines with Jacquard attachments, etc., to pull out a plurality of cover rails, to push the needles and selectors over one another and then to reinsert to cover rails. Considerable expense is also involved when a Jacquard pattern does not extend over the entire width of the knitted article, but if, for example, the borders are monocolored. If this is the case, a set of Jacquard cards must be produced for each size of article. The same applies to articles with a Jacquard design which narrows down. Here again, the edge needles which are transferred, must be selected separately and thus additional Jacquard cards are required.

In the case of straight knitting machines where each needle is associated with an electromagnet for control purposes, the details of very complicated patterns can be supplied to a storage device, but once again it is necessary to store data for each size knitted article separately — and always for the entire article. Thus a plurality of storage devices may be involved. This is especially necessary when it is wished to avoid additional work, for example, for rendering the needles inoperative and when it is not wished to provide the knit locking mechanism with a special mechanical switching device.

A device of the type mentioned initially is disclosed in DL patent 79 106. However, this device does not enable the working width to be readily adjusted.

SUMMARY OF THE INVENTION

The object of the present invention is to provide a device for controlling the patterning and working width which enables the working width to be adjusted simply and automatically both between the individual knitted articles and also during the knitting of one or more knitted articles being worked in rapid succession.

According to the invention this problem is solved in that the devices for limiting the working width are limit switches which are switched by permanent magnets associated in their arrangement with the selection points in the locking mechanism — the arrangement of which points is to be changed.

According to the invention it is possible, for example, to knit all parts of an article in a continuous manner on a straight knitting machine without additional major expenditure.

The device according to the invention is advantageously constructed in such a way that the limit switches are mounted on the sliding carriage at right angles to the direction of travel of the carriage and in that the permanent magnets are mounted on a holder on the needle bed offset with respect to each other in the direction of travel of the carriage.

The holder bearing the permanent magnets is advantageously mounted on a notched bar so as to be lockingly displaceable by one or more needle spacings in the direction of travel of the carriage and so as to be capable of being locked in position.

The holder comprising the permanent magnets can also be mounted for automatic displacement in the direction of travel of the carriage.

A plurality of holders bearing permanent magnets are generally provided along the needle bed, but there is at least one holder on each side of the needle bed.

The device can also be constructed in such a way that one or more additional holders are provided which each bear only one permanent magnet and which are adapted to be moved in the direction of travel of the carriage and to be locked in position.

It may also be advisable for the holders to be adjusted by means of path limiters of thread guide boxes.

The information in the various storage devices can be suppressed in parts by the limit switches which have variable switching points. Thus the working width can be varied even when a plurality of articles are knitted in succession, if, for example, all the needles coming in front of the first and, for example, between the second and third and also after the last limit switch can be kept inoperative even if they should have been operative according to the details of the Jacquard design.

Automatic reduction of the knitted articles is achieved by the automatic displacement of the holders and thus corresponding adjustment of the switching points of the limit switches for reducing the working width.

Other objects, features and advantages of the present invention will be made apparent from the following detailed description of the preferred embodiment thereof provided with reference to the accompanying drawings.

DESCRIPTION OF THE PREFERRED EMBODIMENTS

FIGS. 1–6 of the present application correspond to FIGS. 1, 2, 6, 7, 8 and 12 of U.S. Pat. No. 3,817,059 and reference may be made to the other figures of this patent and the corresponding portions of the specification for a more detailed description of the control circuitry, storage elements, counters and the like which do not form a part of the present invention and are not necessary to an understanding of the present invention which is directed to the physical arrangement of the limit switches and the magnetic switch operators.

Figure 1:
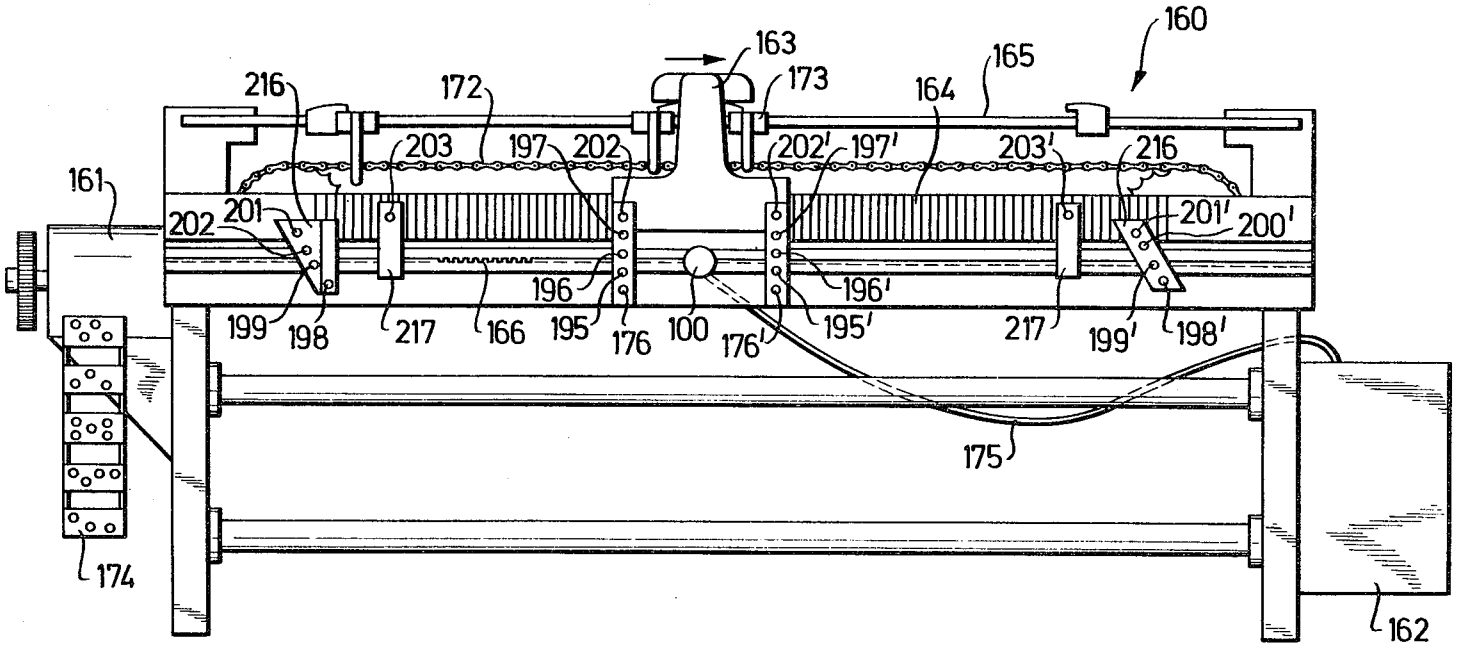
FIG. 1 shows a straight knitting machine having a device according to the invention incorporated therein.

FIG. 1 shows a control device according to the invention mounted on a straight knitting machine 160. A carriage 163 is displaced in a reciprocating manner by drive means 172. The carriage slides over the needle beds 164 and displaces thread guides 173 on thread guide rails 165. The machine is controlled by a control device 161 employing control cards in the form of cardboard cards 174. On the front side of the knitting machine is a notched bar 166 which comprises notches corresponding exactly to the calibrations of the needle bed 164. These notches are scanned by an impulse generator 100 attached to the carriage 163. The scanned area extends on both sides of the machine for at least the length of the carriage 163 over the needle space of the needle beds 164. At each scanned spot an impulse passes from the impulse generator 100 via a feed line in a trailing cable 175 to a storage device 162. This storage device 162 comprises a storage element for selection of the needle graduation, a storage element for the selection of a number of edging needles, an erasable intermediate storage element, a band or plate storage element, counters, other storage devices and a distributor and amplifier unit.

The storage element for selection of the needle graduation or the band or plate storage elements determine which needles are to be moved to a particular selection point 180, 181, 182, 183, (FIG. 6) in the locking mechanism. The control device 161 determines which of these two storage devices is used.

To avoid having to store the data of the entire knitted article when articles are made to size, a further storage element is provided for the selection of a specific number of edging needles. This storage element is controlled by a control device 161 and supplies its data which is scanned by impulses supplied by the impulse generator 100 via the supply line to OR gates and as blocking impulses to blocking AND gates 159. The selected number of needles is only counted off if an impulse from a limit switch 202 has activated another storage element. When the selected number of needles has been counted off, this storage element receives an impulse and is reversed. The next impulse via the supply line comes from the limit switch 202 if the selected number of needles is to be knitted.

A plurality of counters associated with the individual selection points 180, 181, 182, 183, are switched in a continuous manner by the impulse generator 100, progressing gradually from 1 – 36. From 36 the counter jumps with the next impulse directly to 1. The counters are dephased with respect to each other. When the first counter is on 1, the second is on 10, the third on 19 and the fourth on 28, and when the first counter is on 12, the second is on 21, the third on 30 and the fourth on 3 When the carriage moves in the opposite direction, the counters go from 36 – 1.

Figure 6:
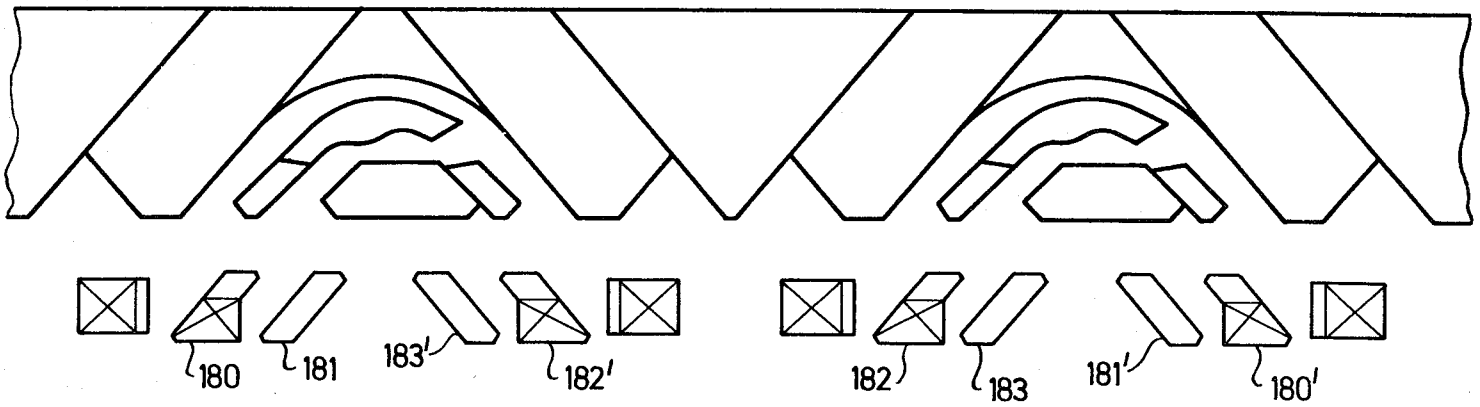
FIG. 6 is a diagrammatic view of selection points in the the locking mechanism which are to be switched.

A line runs from connection 1 of the first counter to one AND gate whereas, from connection 10, for example, a line runs to another AND gate. This applies to each selection point 180, 181, 182, 183, in the locking mechanism (FIG. 6). The spacing of the locking mechanism is such that each selection point 180, 181, 182 and 183 is always located on the selector selected by its particular counter. If the first counter selects 1, the selection point 180 will be located on a selector corresponding to 1. At the same time, the second counter selected 10, and the selection point is located on a selector corresponding to 10. The third counter is then located on 19 and the selection point 182 on a selector corresponding to 19 while the fourth counter is on 28 and the selection point 183 on a selector corresponding to 28. If the carriage 163 moves on by one needle graduation, the first counter 85 will be on 36, the second counter on 9, the third counter on 18 and the fourth counter on 28. The selection point 180 will be on a selector corresponding to 18 and 183 on a selector corresponding to 27, etc. When the carriage moves in the opposite direction the numbers run from 1 – 2.

To select, for example, all selectors corresponding to 1, it is necessary for an impulse to be generated via an OR gate to an intermediate storage element which stores the impulse and retransmits it until the storage element is erased. An amplifier engages all the magnets corresponding to 1, i.e., all the selectors with which a magnet corresponding to 1 is associated project out of the needle bed. However, as the selection point 180 at this time is only located on one of the selected selector bars and all the other selection points 181, 182 and 183 are located on other bars, only this one bar is selected at this time.

Figure 2:
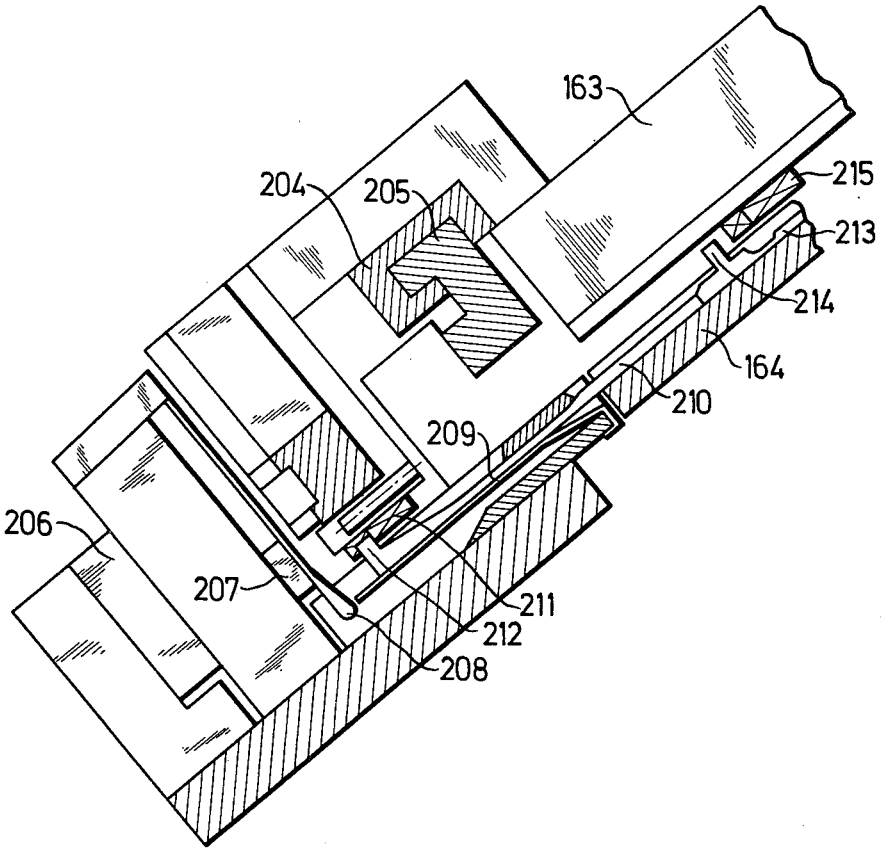
FIG. 2 is a section of a cross-sectional view through the needle bed and carriage of the straight knitting machine.

FIG. 2 shows the section of a selection point. The carriage 163 moves with its guide 204 on a guide rail 205 over the needle bed 164. A control device with adjacent magnets 206 in the form of electromagnets, is located behind the needle bed 164. When the magnet 206 conveys current as shown in the example, a locking spring 208 is either attracted by the cores 207 of the magnets 206 or is cushioned by its own elasticity. In the cushioned state the locking spring 208 blocks a spring 209 which is pressed into the needle bed 164 by the selector 210 during the passage of the carriage. If current has been supplied to the magnet 206 as shown in the embodiment represented, it grips the locking spring 208 against its core 207. The spring 209 pushes the selector 210 upwards until its foot 212 can be gripped by the locking element 211. This locking element 211 pushes the selector 210 and thus the needle 213 upwards so that its foot 214 can be gripped by the needle lifting element 215 and employed in the knitting process.

The locking spring 208 may be provided with a permanent magnet which is attracted by the core 207 of the magnet 206 when current flows in a specific direction through the winding of the magnet and which is repelled when current flows in the opposite direction.

The individual groups of magnets 1' - 36' are controlled via different connections to the particular selection points 180, 181, 182 and 183.

The storage devices for the selection points are put into operation and out of operation by means of limit switches 176, 195, 196 and 197 or 176', 195' 196 and 197' (FIG. 1) which are activated by permanent magnets 198, 199, 200 and 201 or 198' 199', 200' and 201' adjustable on the bar 166. A further storage device is adapted to be put in or out of operation by the limit switches 202 or 202' which are switched by permanent magnets 203 or 203'-which are also adjustable - or by a signal from the control device 161.

Figure 3:
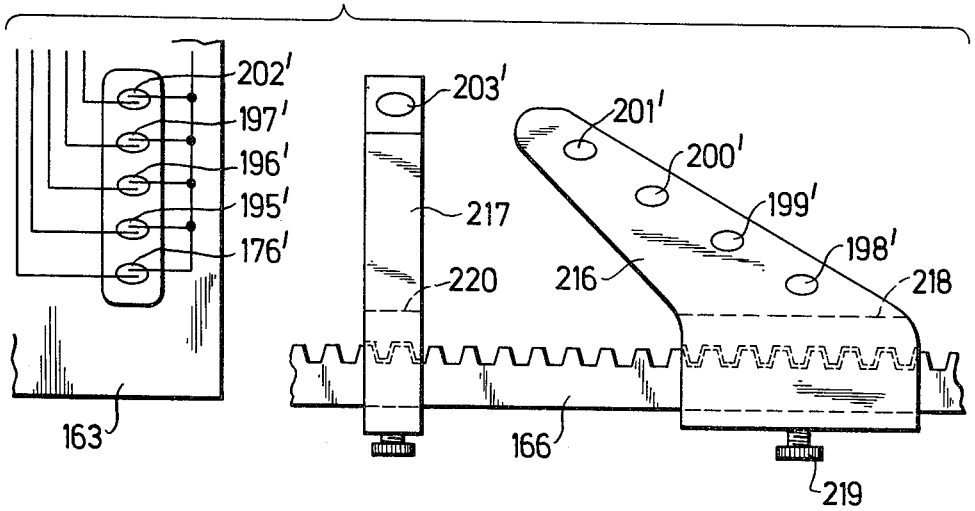
FIG. 3 is a diagrammatic view of the circuitry for limiting the needle spacing by way of the limit switches.

FIG. 3 is a diagrammatic view of the right side of these connections by way of limit switches. The permanent magnets 198' - 201' are stacked in the holders 216 in such a way that the horizontal spacing from one permanent magnet to the next corresponds exactly to the spacing between selection points in the locking mechanism. For example, the spacing between the permanent magnets 198' and 199' is exactly the same as the spacing between the selection points 180' and 181' (FIG. 6). By means of an arresting plate 218 which, like the bar 166 has notches spaced in the same manner as the needle bed 164, the holder 216 can engage at a distance at any desired point in one or more needle graduations. It is held in position by tightening a knurled-head screw 219 and is adjusted with precision. The same applies to a holder 217 which can be held in position by means of its arresting plate 220 at any desired spot on the bar 166 independent of the holder 216.

Figure 4:
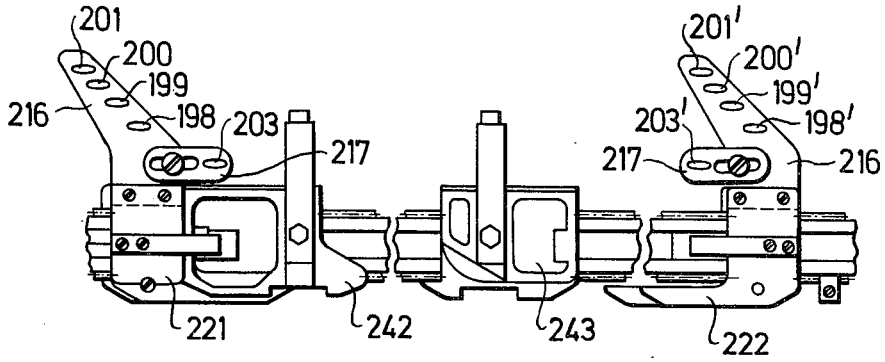
FIG. 4 is a device for automatically adjusting the working width.

The holders 216 and 217 can also be attached to the automatic thread guide adjustment means (FIG. 4). Each time one or more needles is/are added or removed, they are adjusted by means of the path limiters 221 and 222 of the thread guide boxes 242 and 243. In this way, the knitting area is automatically reduced or broadened.

Figure 5:
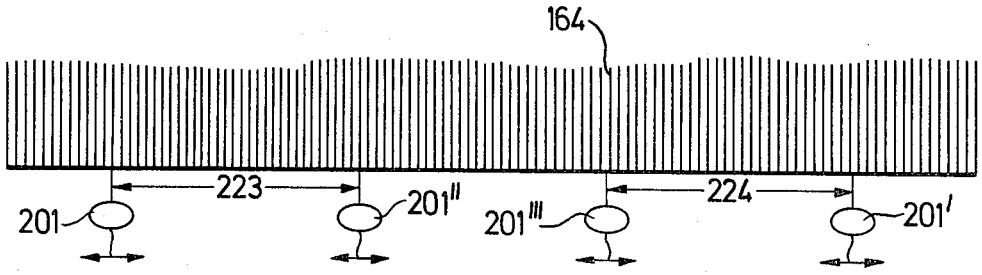
FIG. 5 is a diagrammatic view of adjustment means for altering the working width in the case of two successive knitted articles.

When a plurality, for example, two articles, are knitted in succession, further permanent magnets are attached in the center of the needle space to switch the limit switches. FIG. 5 is a diagrammatic view showing how, for example, permanent magnets 201, 201', 201'', 201''', are secured relative to the needle bed. The arrows show the directions in which the permanent magnets can be adjusted. The two needle areas 223 and 224, in which the knitting operation takes place, are located between the permanent magnets 202''' and 202'.

What is claimed is:

1. A limit switch arrangement for controlling the patterning and working width of a flat-bed knitting machine having a movable carriage comprising a plurality of magnetically responsive limit switches mounted on said carriage in a row at right angles to the direction on travel of said carriage, holder means adjustably mounted on said bed for movement in the direction of travel of said carriage and a plurality of permanent magnets mounted on said holder means with each magnet being offset from the other in the direction of movement of said carriage and in alignment with respective one of said switches.

2. A limit switch arrangement as set forth in claim 1 further comprising a notched bar mounted on said bed and extending parallel to the direction of travel of said carriage with the distance between the notches on said notched bar being equivalent to a needle spacing and locking means on said holder means for securing said holder means in a selected notch.

3. A limit switch arrangement as set forth in claim 1 wherein said holder means is comprised of at least two holders bearing permanent magnets with one holder being provided on each side of said bed.

4. A limit switch arrangement as set forth in claim 3 further comprising additional holder means having only one permanent magnet thereon adjustably mounted for movement on the path of travel of said carriage independent of said holder means.

5. A limit switch arrangement as set forth in claim 1 further comprising movable thread guide boxes mounted on said bed, said holder means being mounted on said thread guide boxes for movement therewith.

* * * * *